United States Patent [19]

Manfroy et al.

[11] 4,136,830

[45] Jan. 30, 1979

[54] ORE GRINDING PROCESS CONTAINING COPOLYMER GRINDING AIDS

[75] Inventors: Willy Manfroy, Carmel, Ind.; Richard R. Klimpel, Midland, Mich.

[73] Assignee: The Dow Chemical Company, Midland, Mich.

[21] Appl. No.: 853,731

[22] Filed: Nov. 21, 1977

Related U.S. Application Data

[63] Continuation-in-part of Ser. No. 687,796, May 19, 1976, abandoned.

[51] Int. Cl.[2] ..... B02C 23/18

[52] U.S. Cl. ..... 241/16; 51/298 R

[58] Field of Search ..... 51/298, 307, 308, 309; 241/16, 18, 20, 22

[56] References Cited

U.S. PATENT DOCUMENTS

| | | | |
|---|---|---|---|
| 2,740,522 | 4/1956 | Almone et al. | 241/16 |
| 2,905,565 | 9/1959 | Dietz | 241/16 |
| 3,104,068 | 9/1963 | Castelli | 241/16 |
| 3,534,911 | 10/1970 | Gwilliam | 241/16 |
| 3,542,575 | 11/1970 | Nelson | 241/16 |
| 3,549,091 | 12/1970 | Slepetys | 241/16 |
| 3,604,634 | 9/1971 | Windle | 241/16 |
| 3,686,111 | 8/1972 | Makhlouf et al. | 241/18 |
| 3,923,717 | 12/1975 | Lalk et al. | 106/90 |

FOREIGN PATENT DOCUMENTS

| | | | |
|---|---|---|---|
| 4720072 | 4/1974 | Australia | 241/16 |

OTHER PUBLICATIONS

"Chem. Enhancement of Ore Grinding Efficiency," Hartley et al. Batelle, Pacific NW Laboratories, Presented at Vail, Cob., Aug. 1976.

"Computer Methods in Mineral Industries," R. Klimpel et al., Oct. 1976, at Penn State University.

*Primary Examiner*—Donald J. Arnold

*Attorney, Agent, or Firm*—G. D. Street

[57] ABSTRACT

A process for grinding coal or ores containing metal values comprising carrying out said grinding in a liquid medium and with a grinding aid comprising copolymers or salts of copolymers of styrene with maleic anhydride, itaconic or citraconic acids dispersible in the liquid medium, said grinding aid being present in an amount effective to provide increased grinding efficiency.

17 Claims, No Drawings

ORE GRINDING PROCESS CONTAINING COPOLYMER GRINDING AIDS

CROSS REFERENCE TO RELATED APPLICATION

This application is a continuation-in-part of our copending application Ser. No. 687,796, filed May 19, 1976, and now abandoned.

BACKGROUND OF THE INVENTION

The present invention relates to the use of copolymers of styrene with maleic anhydride, itaconic or citraconic acids as grinding aids to increase the rate of coal or ore-particle breakage in the wet-grinding of solids in mills such as ball, bead, rod or pebble mills, or in autogenous grinding operations.

In the processing of mineral ores and many other solids, the essential step is the comminution of the solids down to the size at which valuable mineral grains are released from the gangue matrix. With the inevitable trend towards working of lower-grade ore deposits, the amounts of minerals liberated tend to decrease and the grinding cost per ton of product increases. This factor alone constitutes a considerable fraction of the overall cost of winning metals and the increase in cost of energy has made grinding costs a very significant factor.

The amount of breakage per unit of time (breakage kinetics) and mass transfer of grinding mineral ores are usually controlled by the addition and removal of water, an excellent medium because of its high polarity, to the mill. When the mass transport of the slurry through the mill decreases, the mill operator takes corrective action by either decreasing the solids feed rate and/or temporarily increasing the amount of water entering the mill. While both actions will prevent the mill from overloading, mill efficiency is reduced because fewer solids are ground per unit of time under such conditions.

Additionally, it is well known that the traditional tumbling mill apparatus used for wet-grinding ores are extremely inefficient in energy utilization, wasting (based on theoretical bond breakage energies) perhaps as much as 90% or more of the energy supplied to the mill. Therefore, even small increases of a few percent in the reduction of size distribution of ore particles and an increase in throughput of ore ground per unit of time would significantly improve the efficiency of grinding and cost of mill operations, especially with respect to energy utilization.

While various methods and chemical agents that act as grinding aids have been employed in efforts to increase grinding efficiencies and economics, these efforts have at best been only partially beneficial and many have even proved to be contradictory in related downstream processing operations. Various chemical agents, e.g., dispersants, surfactants, polysiloxane, organosilicones, glycols, amines, graphite, non-polar liquids and the like have all been utilized and may increase the rate of grinding by preventing particle agglomeration. However, as reported in Perry's Chemical Engineering Handbook, 5th Ed. 1973, at Sec. 8–12, there really is no scientific method of choosing the most effective surfactant. Rather, surfactant lists and kits that can be used for systematic trails are made available.

Chemical agents, such as polyacrylic acid salts, copolymers of acrylic acid and acrylamide, hydrolyzed polyacrylonitrile and the like are known to be useful as dispersants at low molecular weight ranges. Polymers having a molecular weight from a few thousand up to about 50,000, for example, have been utilized as dispersants in the grinding of calcium carbonate to separate impurities therefrom. See U.S. Pat. Nos. 3,534,911 and 3,604,634.

SUMMARY OF THE INVENTION

The present invention provides a process for grinding coal or ores containing metal values which comprises carrying out the grinding operation in the presence of a liquid medium and an anionic polyelectrolyte grinding aid comprising copolymers of styrene with maleic anhydride, itaconic acid or citraconic acid, said polyelectrolyte being dispersible in the liquid medium and being employed in an amount effective to provide increased grinding efficiency. The use of such grinding aids results in a substantial increase in the rate of particle breakage and permits higher density (solids) slurries of coal or ore to be ground, thereby achieving a greater volume throughput of solid ground per unit of time with a corresponding increase in the recovery rates of the desired metal value where ores are ground. The resulting improved efficiency in the overall grinding operations, i.e., in the use of mill capacity and particularly in the consumption of energy per unit of product, is achieved with the present grinding aids without encountering a decrease in grinding kinetics normally observed when higher density slurries are ground.

It has also been found that the polyelectrolyte grinding aids of the present invention usually do not detrimentally effect downstream processing operations which are performed, particularly on mineral ores, after the mineral leaves the grinding mill. Thus, for example, the polyelectrolyte grinding aids generally do not detrimentally effect processes such as, for example, froth flotation processes in which select metal values such as copper, lead, zinc or gold are recovered from the ore with the aid of flocculating and deflocculating agents. Neither do the polyelectrolyte grinding aids of the present invention have any counterproductive effects in subsequent operations such as, for example, in pelletizing iron ore. Since the polyelectrolyte is adsorbed on the solids, the system does not contribute to downstream pollution problems upon discharge of the aqueous medium such as might be the case with phosphatic materials, for example.

DETAILED DESCRIPTION OF THE INVENTION

The method of the present invention is preferably carried out in the presence of a polar liquid medium in which the grinding aid is sufficiently dispersible to produce an improvement in grinding efficiency, although the use of a liquid medium comprising a liquid which itself is not a solvent for the grinding aid may be feasible provided that a solvent or dispersant for the grinding aid is also present. Accordingly, the term dispersible means the aids are soluble or dispersible in the medium employed to an extent sufficient to provide adsorption thereof on the solid particles and increased grinding efficiency. Water is ordinarily employed and is the preferred medium. The concentration of the solids, e.g., ore or coal, in the liquid medium may vary within wide limits and it is usual to operate with a slurry solids content in the range of from about 40 to about 95, preferably about 50 to about 90, more preferably from 65 to about 88% and most preferably from 70 to about 88, percent by weight of the slurry. Metal ores which may advantageously be treated according to the present invention include iron, copper, gold, silver, lead, zinc nickel and the like which can be subjected to a wet-grinding treatment. In a preferred embodiment, an ore containing a metal value is ground according to the process of the invention. In another embodiment, coal is preferably ground according to the invention process.

The polyelectrolyte grinding aid used in the present invention is suitably any copolymer of styrene with maleic anhydride, itaconic or citraconic acid which is inherently dispersible in the liquid medium employed. Preferably, the polyelectrolyte is dispersible as colloidal size particles in the liquid medium without the aid of surfactants. The water soluble salts of the copolymers are preferably employed and may be that of an alkali metal, for example, sodium, potassium, lithium or the like, or may be an ammonium salt. The alkali metal salts, especially the sodium salts, are preferred. Such copolymers preferably contain approximately one to one mole ratio between the styrene and the maleic anhydride itaconic, or citraconic acid salts for use as grinding aids herein. Usually, styrene-maleic anhydride copolymers must be post-hydrolyzed and contain about 17 or more mole % of maleic anhydride. A further modification of the invention entails the partial sulfonation of the styrene fraction of the copolymer. The sulfonation of the styrene can be done either before or after the polymerization. A preferred grinding aid is styrene maleic anhydride. In another embodiment, copolymers of styrene with itaconic and citraconic acids are preferred. Styrene maleic anhydride copolymers wherein the styrene is partially sulfonated constitute a further preferred embodiment.

Water-soluble copolymers of the type exemplified above are known and can be prepared by a variety of methods. Examples of suitable water-soluble polymers include, for example, available products such as, for example, SMA 2000A (available from the Arco Chemical Company).

Grinding aids of the type exemplified above are known and can be prepared by those skilled in the art by various methods.

Generally, the anionic group of the grinding aid has a pKa of about 6 or less, wherein pKa is a negative logarithm of the acidity constant for the acidic (anionic) group. The average molecular weight of the water-soluble or dispersible copolymers and salts thereof usually ranges from about one thousand up to about fifty thousand. Preferably, grinding aids having an average molecular weight (as determined by the Mark Houwink equation) of from about 1000 to about 20,000, and preferably from about 1000 to about 10,000, are employed. The upper limit on molecular weight is not critical; however, it is known that some very high molecular weight polymers are difficult to get into solution but that colloidal dispersions thereof can be formed in the medium. Polyelectrolytes which are otherwise insoluble or non-dispersible in the medium are not included within the scope of the invention.

It has been found that the effectiveness of the polyelectrolyte grinding aid relates to the number of anionic groups in the polyelectrolyte. In one means of determination, the number is found to be sufficient if the polyelectrolyte effects a minimum 10% reduction in the low shear viscosity of a slurry when the polyelectrolyte is added to the slurry in an amount sufficient to provide a concentration of 0.06 weight percent of polyelectrolyte based on total mineral solids. By low shear viscosity is meant Brookfield viscosity determined with a Brookfield viscometer using a D bar at 25° C. and 5 rpm. By slurry it is meant that coal or a mineral is ground to a particle size of 325 mesh and that the concentration of solids in the liquid medium is between about 50 to about 95% by weight. Preferred polyelectrolytes effect at least about a 20% viscosity reduction under such conditions, with the most preferred effecting a viscosity reduction of at least about 40%. So long as viscosity reductions in this range are effected, the number of anionic groups in the polyelectrolyte is not particularly critical. However, as a general rule, the polyelectrolytes advantageously employed have a proportion of anionic groups in the polyelectrolyte such that there are at least about 1, preferably about 2 or more, milliequivalents of anionic moiety per gram of the polyelectrolyte.

The amount of grinding aid employed to increase grinding efficiency, e.g., the rate and type of ore-particle breakage, e.g., ore classification, which can respectively be described as the "selection" and "distribution" functions of grinding, will vary depending upon certain factors including properties which are unique to coal and each ore. For example, the "selection function", which describes the probability that a particle of any particular size will be broken in a given unit of time, will be affected by any factors which change the probability of particle breakage. Factors such as slurry volume, number and size of grinding media (e.g., balls, rods, etc.), raw ore particle size, mill rpm and the like, as well as ore properties, all affect the probability of successful particle breakage. The properties unique to coal or each ore also affect the "distribution function", that is, the number and size distribution of fragments into which a particle will subdivide when it is broken. Measurement of the number of and size distribution of fragments after grinding will allow the calculation of the effect of the aid on the selection and distribution functions which will indicate the effectiveness of the grinding aid added. Further reference to the use of selection and distribution functions in determining the effect of grinding aid materials in wet grinding process can be found in Klimpel, R. R., and Manfroy, W., "Computer Analysis of Viscosity Effects on Selection for Breakage and Breakage Distribution Parameters in the Wet Grinding of Ores", *14th Int. Sym. on Appl. of Computers in the Mineral Ind.*, Pennsylvania State U., University Park, Pa., Oct. 1976;

Klimpel, R. R., and Manfroy, W., "Grinding Aids for Increased Throughput", *Symposium of Canadian Min. Proc.*, Ottawa, Canada, Jan. 1977;

Klimpel, R. R., and Manfroy, W., "Development of Chemical Grinding Aids and Their Effect on Selections-for-Breakage and Breakage Distribution Parameters in the Wet-Grinding of Ores", *Proc. 12th Int. Min. Proc. Congress*, Aug.-Sept. 1977, Sao Paulo, Brazil.

Grinding efficiency can, for example, be determined from the amount of particulate solid of particle size less than 325 mesh (44 micrometers) U.S. Standard, that can be formed from a given liquid slurry of constant volume of liquid and ore solids using the same energy input. Normally, as the weight percent of ore solids in this slurry is increased, the grinding efficiency of the grinding medium is reduced. Thus, it is critical in the practice of this invention that the amount of polyelectrolyte grinding aid employed be sufficient to reverse the trend towards a lower grinding efficiency as weight percent concentration of ore solids in the slurry is increased.

The liquid slurry preferably contains grinding media wherein the media are as employed in large ore grinding mills such as ball, bead, rod or pebble mills. The media are generally of a size large enough where they do not contribute to an increase in the inherent viscosity of the slurry. Thus, the type of mills under consideration here are distinct from those mills in which paint pigments are ground to an extreme fineness with an extremely small granular grinding medium.

Generally, the effective amount of grinding aid employed to increase the rate of ore grinding can be as low as about 0.002 percent by weight (of actual polymer) based on the dry weight of the ore present. The maximum amount of grinding aid employed is usually limited by economic constraints, i.e., the high cost of the grinding aid. Preferably, the grinding aids of the present invention are employed in the range of from about 0.003 to about 0.08% by weight of actual polymer (i.e., from about 0.03 to about 0.8 milligram per gram) preferably, from about 0.1 to about 0.04% by weight. The optimum amount of aid from an economic and/or utility viewpoint will, of course, depend upon, inter alia, the particular ore to be ground and other various factors as described hereinabove. Those skilled in the art can readily ascertain the same according to the procedures set forth herein or others known in the art.

In batch operations, grinding periods of from 5 to 10 minutes or longer are usually sufficient to measure an increase in the fineness of grind when using a grinding aid as taught herein. In open cycle continuous grinding operations, the increased throughput and/or increased fineness of grind at constant throughput is readily ascertained. In continuous closed cycle grinding operations, however, much of the ore being ground is continuously recycled through the grinder until the desired degree of fineness is obtained and the actual grinding time per unit of ore can only be calculated on an average residence basis. This will vary with the type of ore used and the amount of grinding required to meet size distribution requirements. With iron ore, for instance, grinding must be continued until the particle size is less than 325 mesh (U.S. Standard), sometimes less than 500 mesh. Again, those skilled in the art of grinding will be able to ascertain the grinding time needed.

Increases in grinding kinetics are determined by measuring the change in the weight and size distribution of fragments obtained per unit of time. An increase in the amount of grinding or fineness of grind as determined by measurement of the particle sizes resulting per unit grinding time means that more grinding takes place. Illustrating the increased grinding rates achieved in another manner, it is readily apparent that if a grinding viscosity of, for example, 50,000 cps is desired and the untreated ore slurry is at 68% solids, one can grind a higher solids density slurry of, for example, 72% solids, by use of a grinding aid without any change in grinding conditions. Increases in the grinding rate of only a percent or two, while numerically small, are highly desirable as they represent truly significant savings in energy costs. According to the methods of the present invention, experimental data indicates that increases of from about 1 to about 20 percent of the grinding rate can be achieved with the use of grinding aids taught herein.

In determining the usefulness of a particular agent as a grinding aid, various chemicals can be first screened to determine the ability of a particular chemical agent to decrease the viscosity of a finely ground ore. Those agents generally found to decrease the viscosity of the finely ground ore (ground to a particle size of 325 mesh and having a solids concentration between about 50 to 95% by weight) by about 20-25 percent or more are usually subsequently found to be very effective as grinding aids. Generally, the greater the decrease in slurry viscosity, the greater the increase in grinding. However, viscosity data alone is not sufficient by itself to predict that any increase in grinding efficiency will necessarily result or to indicate the degree of any increase in grinding efficiency which might be obtained. This will have to be determined by actual grinding trials. In carrying out actual grinding tests, an ore sample is first ground in a typical ball mill using plain water as a liquid phase. After each grinding run of a predetermined time, the size distribution of the product is determined by wet screening. Enough runs are made with different grinding periods and slurry concentrations so that the change in the weight and size of fragments can be determined. The runs are then repeated incorporating a grinding aid into the slurry and making the same determinations. The changes in the size and weight of fragments as compared with the controls indicate the effectiveness of the grinding aid.

The following examples are presented to illustrate the invention, but are not to be construed as limiting it in any manner whatsoever. The ore slurry percent is based on the weight of solids present in the slurry being treated and the milligrams per gram is based upon the number of milligrams of actual grinding aid per gram of ore.

EXAMPLE 1

Various chemical agents were screened to determine the effectiveness thereof in decreasing the viscosity of a finely-ground ore. In such operations, ground ore was mixed with sufficient water to form a viscous slurry, usually between about 100,000 and 150,000 cps. The viscosity of the slurries were measured with the use of a Brookfield viscometer fitted with a crossbar and helipath stand, the helipath slowly moving the revolving crossbar (at 5 rpm) vertically so that the bar continuously encounters undisturbed slurry. A base viscosity curve of untreated slurry is first determined. Then a dilute solution of the test agent is added in 5 small equal increments of 1 cc each to the slurry. The viscosity change is plotted as a function of treatment level and the results compared with the untreated slurries.

In such operations, the viscosity of slurries treated with various levels (mg/gm of ore) of styrene-maleic anhydride copolymers was found to be decreased as compared with control samples:

TABLE I

| | Ore | Aid | mg/gm | % Decrease Slurry Viscosity |
|---|---|---|---|---|
| 1. | Taconite[a] | A | 0.2 | 23 |
| 2. | Taconite[b] | " | " | 50 |
| 3. | Gold | " | " | 19 |
| 4. | Iron[c] | B | 1.0 | 60 |
| 5. | Copper[d] | " | " | 30 |
| 6. | Copper[e] | " | " | 43 |
| 7. | Iron[b] | " | " | 57 |

A=Styrene maleic anhydride copolymer, m.w. 2000, 1:1 mole ratio, disodium salt form.

B=Styrene maleic anhydride copolymer, m.w. 2000, 1:3 mole ratio, disodium salt form.

[a]Eleveth
[b]Sherman
[c]Hanna
[d]Morenci
[e]Kingman

Substantial decreases in viscosity were also obtained with other concentrations and other copolymers hereof with styrene. Subsequent evaluations of those agents substantially reducing the viscosity of the ore slurries in ore grinding operations at the same or lower concentrations indicated surprising and significant increases in grinding kinetics.

EXAMPLE 2

A ball mill, 19.5 centimeters (cm) internal diameter and about 20 cm in length, operated at about 60 rpm and containing about 110 one-inch steel balls, was utilized for grinding studies on various ores to determine the effectiveness of using grinding aids of the present invention. In such operations, the ore was crushed to pass through a 10 U.S. mesh screen and then mixed with appropriate amounts of water in the mill to form slurries of desired concentrations. Once the desired slurry concentration was formed, the mill was sealed and operated for various grinding periods, after which the resultant ground ore slurry was removed and the amount of particles passing through a 325 U.S. mesh screen determined. The trials were then repeated, using the same concentrations and grinding times, with the addition of various amounts of a grinding aid to the aqueous slurry prior to grinding. The results of such operations, indicating the effectiveness of the grinding aid in improving grinding kinetics, are set forth below:

TABLE II

| Run No. | Grinding Aid | mg/gm | Grinding Time mins | Wt. % Passing 325 Mesh | * % Increase | Ore Slurry % |
|---|---|---|---|---|---|---|
| 1. | None | 0 | 30 | 37.5 | — | 84% taconite |
| 2. | **A | 0.5 | " | 38.0 | 1.3 | " |
| 3. | None | 0 | 60 | 47.0 | — | " |
| 4. | **A | 0.5 | " | 53.0 | 11.3 | " |

*=% increase as compared with control
**A=styrene-maleic anhydride, mol. wt. 2000, 1:1 mole % ratio, styrene to maleic anhydride; sodium salt.

The above data indicate that, with any fixed comparative grinding time, the weight percent passing 325 mesh is higher in instances where a grinding aid was employed. A significant increase in the grinding kinetics was demonstrated at low amounts of grinding aid even where a relatively short grinding period was utilized (Run No. 2, 30 minutes with 0.05 weight percent grinding aid). Very dramatic and surprising increases in grinding are indicated where longer grinding times are employed, an increase of more than 10% in the amount of ore passing through a 325 mesh screen being obtained after 60 minutes.

Measurements at other particle sizes and ranges also indicated similar significant increases. Other grinding aids of the invention are also similarly found to be effective in increasing the grinding kinetics with the above and other ore sources.

While this invention has been described with reference to certain specific embodiments, it is of course to be understood that the invention is not to be so limited except insofar as appear in the accompanying claims.

We claim:

1. A process for grinding coal or ores containing metal values comprising carrying out said grinding in the presence of a liquid medium and a polyelectrolyte grinding aid comprising copolymers of styrene with maleic anhydride, itaconic acid or citraconic acid, said grinding aid being dispersible in said medium, and being employed in an amount effective to provide increased grinding efficiency.

2. The process of claim 1 wherein the grinding aid is a copolymer of styrene with maleic anhydride.

3. The process of claim 1 wherein the grinding aid is a copolymer of styrene with itaconic acid.

4. The process of claim 1 wherein the grinding aid is a copolymer of styrene with citraconic acid.

5. The process of claim 1 wherein ores containing metal values are ground.

6. The process of claim 1 wherein coal is ground.

7. A process for grinding coal or ores containing metal values comprising carrying out said grinding in the presence of a liquid medium and a polyelectrolyte grinding aid comprising salts of copolymers of styrene with maleic anhydride, itaconic acid or citraconic acid, said grinding aid being dispersible in said medium, and being employed in an amount effective to provide increased grinding efficiency.

8. The process of claim 7 wherein the grinding aid is a salt of a copolymer of styrene with maleic anhydride.

9. The process of claim 7 wherein the grinding aid is a salt of a copolymer of styrene with itaconic acid.

10. The process of claim 7 wherein the grinding aid is a salt of a copolymer of styrene with citraconic acid.

11. The process of claim 7 wherein the grinding aid is a water-soluble salt of styrene with maleic anhydride, itaconic acid or citraconic acid.

12. The process of claim 11 wherein the salt is an alkali metal or ammonium salt.

13. The process of claim 12 wherein the salt is an alkali metal.

14. The process of claim 13 wherein the alkali metal salt is sodium.

15. The process of claim 7 wherein the grinding aid is a sodium salt of styrene maleic anhydride.

16. The process of claim 7 wherein ores containing metal values are ground.

17. The process of claim 7 wherein coal is ground.

* * * * *